US007204402B2

(12) United States Patent
Burke et al.

(10) Patent No.: US 7,204,402 B2
(45) Date of Patent: Apr. 17, 2007

(54) PNEUMATIC TOOL WITH AS-CAST AIR SIGNAL PASSAGE

(75) Inventors: Brian C. Burke, Barrington, RI (US); Prudencio S. Canlas, Jr., North Kingstown, RI (US); David J. Simonelli, Coventry, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 287 days.

(21) Appl. No.: 10/406,579

(22) Filed: Apr. 4, 2003

(65) Prior Publication Data

US 2004/0020965 A1 Feb. 5, 2004

Related U.S. Application Data

(60) Provisional application No. 60/369,802, filed on Apr. 5, 2002, provisional application No. 60/369,882, filed on Apr. 5, 2002, provisional application No. 60/369,884, filed on Apr. 5, 2002.

(51) Int. Cl.
*B27F 7/02* (2006.01)
*B27F 7/09* (2006.01)
*B27F 7/13* (2006.01)

(52) U.S. Cl. ..... 227/8; 227/130; 227/136

(58) Field of Classification Search ..... 227/8, 227/130, 136; 92/164, 169.1
See application file for complete search history.

(56) References Cited

U.S. PATENT DOCUMENTS 3,094,901 A 6/1963 Wandel et al.
3,106,136 A * 10/1963 Langas et al. ..... 91/417 A
3,162,092 A * 12/1964 Corwin ..... 91/26
3,229,589 A * 1/1966 Langas ..... 91/416
3,351,256 A 11/1967 Readyhough
3,496,840 A 2/1970 Wandel et al.
3,512,454 A 5/1970 Perkins
3,567,098 A * 3/1971 Maynard ..... 227/5
3,572,572 A 3/1971 Readyhough
3,584,776 A 6/1971 Bolte
3,708,095 A 1/1973 Briggs, Jr.
3,708,096 A 1/1973 Burke, Jr.
4,011,785 A 3/1977 Schrepferman
4,053,094 A 10/1977 Males
4,393,993 A * 7/1983 Kille et al. ..... 239/332
4,401,251 A * 8/1983 Nikolich ..... 227/130
4,856,696 A 8/1989 Seld (Continued)

*Primary Examiner*—Louis K. Huynh
*Assistant Examiner*—Nathaniel Chukwurah
(74) *Attorney, Agent, or Firm*—Pillsbury Winthrop Shaw Pittman LLP

(57) ABSTRACT

A fastener driving device includes a housing containing a chamber for storing compressed air a cylinder structure disposed within the housing, a piston movably disposed within the cylinder, a driver connected to the piston, a main valve cooperable with the cylinder structure and movable between an open position and a closed position. The main valve in its open position allows air to move the piston through a drive stroke. The fastener driving device also includes a trigger valve operable between first and second positions. The trigger valve in its first position communicates air pressure from the chamber to the main valve through a signal passageway so as to retain the main valve in a closed position. The trigger valve in its second position allows the air to be exhausted to atmosphere through the signal passageway to permit the main valve to open. The cylinder and the signal passageway comprise an integrally molded structure.

5 Claims, 3 Drawing Sheets

U.S. PATENT DOCUMENTS 4,909,419 A * 3/1990 Yamada et al. ..... 227/1
5,259,465 A 11/1993 Mukoyama
5,437,339 A 8/1995 Tanaka
5,671,880 A 9/1997 Ronconi
5,732,870 A 3/1998 Moorman et al.
5,873,510 A 2/1999 Hirai et al.
5,918,788 A 7/1999 Moorman et al.
6,006,975 A 12/1999 Ishizawa
6,039,231 A 3/2000 White
6,065,662 A * 5/2000 Sauer ..... 227/130
6,079,605 A 6/2000 Braun et al.
6,719,067 B2 * 4/2004 Taga ..... 173/93.5

* cited by examiner

PNEUMATIC TOOL WITH AS-CAST AIR SIGNAL PASSAGE

The present application claims priority to U.S. Provisional Application Nos. 60/369,802, 60/369,882, and 60/369,884, all filed on Apr. 5, 2002. The entire contents of the three applications are incorporated herein by reference.

BACKGROUND

1. Field of Invention

This invention relates to fastener driving devices and, more particularly, to fastener driving devices of the portable type.

2. Discussion of Related Art

Fastener driving tools for driving fasteners such as nails, staples or the like are commonly used in industry and commerce. The fasteners are generally supplied from a collated strip or stick of fasteners disposed in a magazine coupled to a nose-piece portion of the fastener driving tool. The fastener driving tool also comprises a housing to store compressed air provided from an external source, and a cylinder is disposed within the housing. A piston is slidably disposed in the cylinder and a driver is connected to the piston. A main valve can be opened above the cylinder to provide pressurized air to the piston operating the driver. A trigger valve is also provided and sends a pneumatic signal to operate the main valve.

The pneumatic signal is routed from the trigger valve to the main valve via an air passage. Conventional tools typically utilize an air signal passage that is machined into the tool housing or frame.

The machining of the air signal passage in the prior art devices is expensive and time consuming. In addition, the machining step introduces surface irregularities thus potentially creating leaks in the housing.

Therefore, it is desirable to overcome these and other limitations thus allowing overall improved performance and reduced cost of the fastener tool.

BRIEF DESCRIPTION OF THE INVENTION

Other aspects of the present invention is to provide a device of the type describe above which is combined with other features hereafter described in detail.

In accordance with one aspect of the present invention, a fastener driving device includes a housing containing a chamber for storing compressed air a cylinder structure disposed within the housing, a piston movably disposed within the cylinder, a driver connected to the piston, a main valve cooperable with the cylinder structure and movable between an open position and a closed position. The main valve in its open position allows air to move the piston through a drive stroke. The fastener driving device also includes a trigger valve operable between first and second positions. The trigger valve in its first position communicates air pressure from the chamber to the main valve through a signal passageway so as to retain the main valve in a closed position. The trigger valve in its second position allows the air to be exhausted to atmosphere through the passageway to permit the main valve to open. The cylinder and the signal passageway comprise an integrally molded structure.

In another aspect of the invention, the trigger valve is operable between a first position wherein the trigger valve establishes a first pressure signal at the main valve through a signal passageway so as to retain the main valve in a closed position. The trigger valve in its second position establishes a second pressure signal at the main valve through the passageway to permit the main valve to open. The cylinder and the signal passageway comprise an integrally molded structure.

In one embodiment, the structure comprising the cylinder and the signal passageway are molded from plastic.

DETAILED DESCRIPTION OF THE PREFERRED EMBODIMENT

Figure 1:
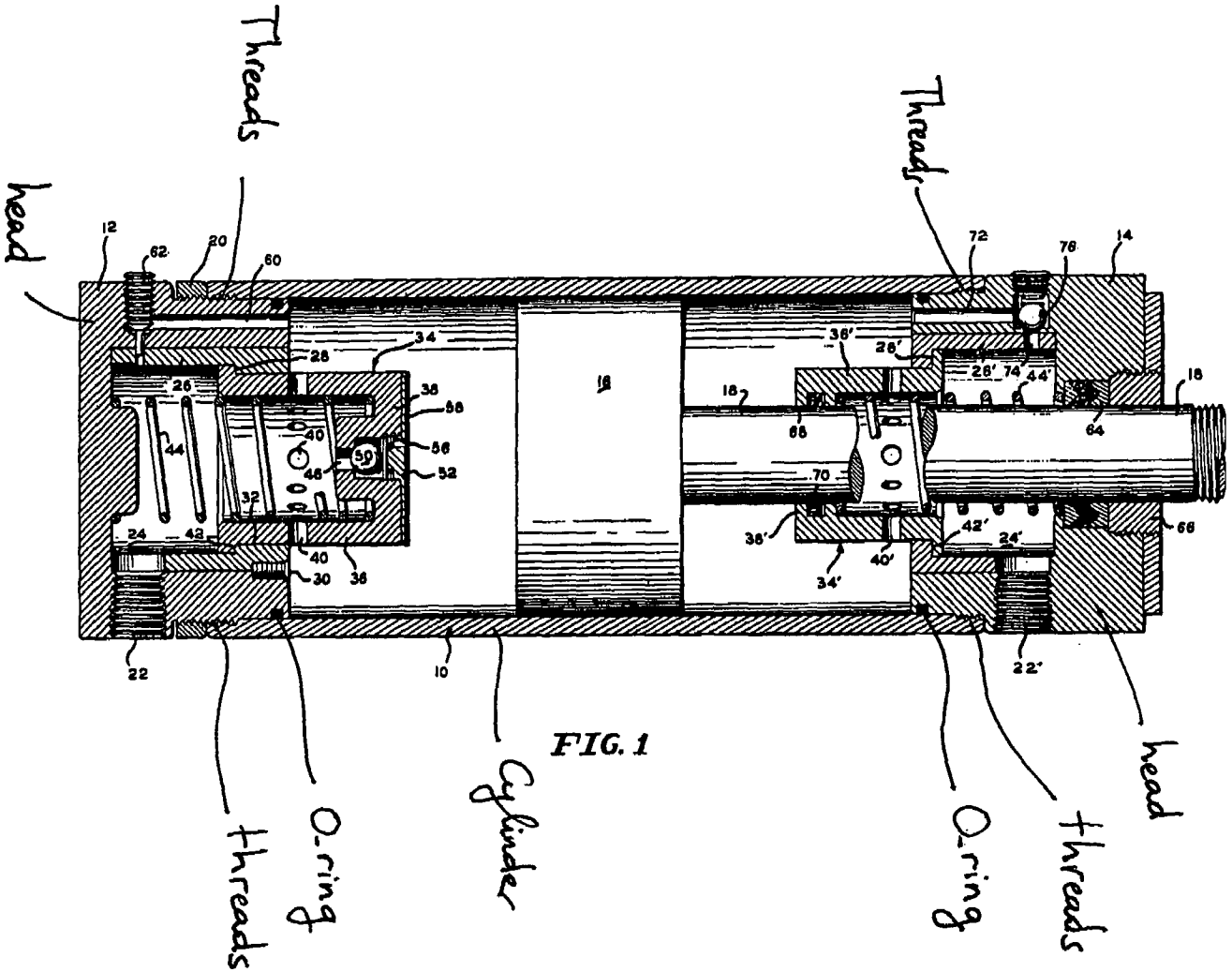
FIG. 1 is a cross-sectional view of the fastener tool embodying the present invention.

Referring now to the drawings, more particularly referring to FIG. 1, there is shown therein a fastener driving device, generally indicated at 10, which embodies the principles of the present invention. The operation of device 10 is explained more fully in U.S. Application Ser. No. 60/369,884, which is hereby incorporated by reference. The tool comprises housing 12 having, among other things, a cylinder containing body portion 14, a handle portion 16 and a cap portion 18. The size and shape of these components can vary considerably depending on the type of fastener and application, but all have in common an internal air chamber 20 for containing compressed air, for example, from an external source.

The compressed air chamber 20 is pressurized from an air supply line through an inlet connection attached to the handle (not shown). In this particular embodiment, the cap 18 may be attached to the body portion 14 with screws (not shown). Part of the volume in cap 18 is used to enlarge the volume of the compressed air chamber 20. The body portion 14 and cap 18 are joined by seals 22 to prevent compressed air from escaping into the atmosphere.

The body portion 14 also includes a return air chamber 24. The return air chamber 24 is pressurized when the piston 26 is near the end (bottom) of its downward drive stroke. The sequence of pressurizing the return chamber 24 will be described in detail below. The chambers 20 and 24 are separated by seals 25.

The lower portion of the housing 12 is connected to a fastener carrying rail or magazine 28. The front of the rail 28 commonly is defined by a nosepiece 30, which is provided with a guide cavity 32. A fastener pusher within magazine 28 (not shown) delivers the fastener into the nose cavity 32 underneath the end of a driver 33. The driver 33 is fixed to the piston 26 and function together as a unit. A cylinder 34 is mounted in the housing 12. The piston 26 reciprocates in the cylinder 34 during operation. To control the movement of the piston 26, a trigger valve 36 positioned near the handle 16 and a main valve 38 are employed. A passageway 27 permanently allows the pressure in chamber 20 to communicate with region 35 of main valve 38. While the main valve 38 and trigger valve 36 can be any such valves as known in the art, it is preferred for the main valve 38 to be made and operated in accordance with a co-pending commonly assigned US. patent application entitled "Pneumatic Tool With Self-Sealing Diaphragm Valve System" Ser. No.

60/369,884, filed on Apr. 5, 2002, the content of which is incorporated herein by reference.

In FIG. 1, the trigger valve 36 is positioned so as to permit pressurized air from chamber 20 to communicate through the valve 36, through signal passageway 43 and to the chamber 44 above the main valve 38. The trigger valve 36 is controlled by a manual lever 40 as shown in FIG. 1. The signal passageway 43 allows air pressure signal to communicate between trigger valve 36 and main valve 38 through passage 104, shown on FIG. 1 in dotted lines, so as to enable continuous communication with region 35 between first sealed portion 37 of main valve 38 and second sealed portion 39 of main valve 38. In this condition, main valve 38 is retained in a closed position due to the fact that the surface area on the valve 38 that is exposed to chamber 44 is greater than the surface area of the valve 38 exposed to region 35, so that although there is equal pressure in regions 44 and 35, there is a net downward force on the main valve 38 to retain portion 39 of the main valve 38 in sealed relation to the upper end 41 of cylinder 34. Actuation of the lever 40 causes trigger valve 36 to seal the chamber 20 from the signal passageway 43 and the same time opens the passageway 43 to atmosphere to permit pressure in the passageways 43 and chamber 44 to exhaust through the valve 36. The passageway 43 is pressurized again when lever 40 is released and the valve 36 is closed. The embodiment of the tool shown in FIG. 1 is that of a manually operated tool, but should a tool be part of a stationary application the trigger valve means could be a remotely located valve and operated by something other than lever 40. The signal passageway 43 is formed at least in major part as an integral structure with the cylinder 34. It can be appreciated, however, that a portion of the signal passage may be considered to reside also in the housing for trigger valve 36 or other portion of the housing 12. A peripheral seal structure 121 surrounds an upper portion of cylinder structure 34 and an upper portion of said signal passageway 43 to facilitate air pressure communication of the upper portions.

A movable contact trip assembly 46 is mounted so as to have a forward end extend outwardly of the nosepiece 30 to be actuated when the device 10 is moved into operative engagement with a workpiece. The contact trip 46 includes fastener depth adjusting mechanism indicated as 48 capable of being conveniently manually adjusted in a manner to determine the countersink depth of the driven fasteners. For details of a preferred construction, reference may be had to a co-pending commonly assigned US. patent Application entitled "Pneumatic Fastening Tool With Fastener Depth Adjusting Mechanism" Ser. No. 60/369,882, filed on Apr. 5, 2002, the content of which is incorporated herein by reference.

The sequential operation of the above-described fastener driving apparatus will now be described.

At rest, chamber 20 communicates through trigger valve 36, through passageway 43 into the chamber 44 above the main valve 38. The surface area of main valve 38 exposed to region 44 above the main valve is greater than the surface area of main valve 38 exposed to region 38 below the main valve. Thus, although both regions 35 and 44 are exposed to the pressure in chamber 20, the greater surface area exposed to volume 44 causes the main valve to seal. When the trigger 46 is pulled against the bias of a coil spring 49, valve stem 86 is raised when contacted by surface 51 of the trigger assembly so that the upper O-ring 87 seals the air pressure chamber 20 from the signal passageway 43 and the lower O-ring 39 is unsealed to enable the chamber 44 above the main valve 38 to exhaust through passageway 43 to the atmosphere through valve 36. Because chamber 21 is always exposed to air pressure chamber 20, and because such chamber 21 communicates with the region 35, the air pressure in region 35 will cause the main valve 38 to move to its unsealed position when the region 44 is exhausted to atmosphere. It can be appreciated that the region 35 is disposed between the first sealed portion 37 of the main valve and the movable second sealed portion 39 of the main valve. The pressure in region 35 causes a rolling flexure of portion 61 of the main valve to enable portion 39 to lift and unseal from the portion 41 of cylinder 34.

The opening of the main valve 38 allows the air to enter the top or first portion of the cylinder 34 above the piston 26. At the same time, the air communication of the upper portion of the cylinder 34 above the piston 26 to the atmosphere through exhaust passage 50 is blocked by sealingly closing the passageway 52 in the center of main valve 38 from the exhaust passageway 50. Specifically, when the main valve is raised in the open position, the upper surface of portion 90 of the main valve seals to the top member 91 of cap 18. Specifically, the upward movement of main valve 38 allows cylindrical plastic portion 90 of main valve 38 to sealingly contact stop member 91 to seal passageway 52 from exhaust path 50. The piston 26 along with driver 33 are forced downward rapidly. The driver 33 or fastener striker pushes the fastener out of the drive track 32 in nosepiece 30 with enough force to drive the fastener into the workpiece.

Near the end of the drive stroke, the piston 26 passes one way check valves 58 in the cylinder 34 that allows air to enter and pressurize return air chamber 24 during the downward stroke. At the end of the drive stroke, the underside of the piston 26 contacts a shock absorber 54. After lever 40 is released, valve stem 36 is lowered under the force of coil spring 71 so that the lower O-ring 39 seals and the upper O-ring 87 unseals to permit the air pressure in chamber 20 to enter again the passageway 43 to enable the chamber 44 above the main valve 38 to be pressurized again through passageway 43. Therefore, the air pressure in the chamber 44 above main valve 38 is equalized with the air pressure in chamber 21 which is always exposed to air pressure chamber 20 (through passageway 45). The surface area of main valve 38 exposed to region 44 above the main valve is greater than the surface area of main valve 38 exposed to region 35 below the main valve. Thus, although both regions 35 and 44 are exposed to the pressure in chamber 20, the greater surface area exposed to volume 44 causes the main valve to go back to its initial sealed position. The main valve 38 is pneumatically balanced towards the closed position whenever both the upper and lower sides are subjected to equal air pressure. The main valve 38 thus closes when cavity 44 is pressurized.

It should be appreciated that the principles of the present invention apply to what are known in the art as half-cycle valving systems, full cycle valving systems, and automatic cycle valving systems.

The shifting of the main valve 38 to the closed position unseals the sealing engagement between the plastic portion 90 of main valve 38 and the stop member 91 so as to allow the space above the piston 26 during upward travel of the piston 26 to exhaust through passageway 52 and exhaust passage 50 to atmosphere. The air above the piston 26 exhausts sequentially through canal 89, passageway 50 and an exhaust port (not shown). When the air pressure above the piston 26 drops below that under the piston 26, the air in the return air chamber 24 enters the cylinder 34 under the piston 26 through canal 59 and forces the piston 26 and driver 33 upward. Return air chamber 24 has a fixed volume, thus as piston 26 moves upward the pressure in return air chamber 24 is reduced.

The return air chamber 24 is designed with sufficient volume to provide enough air to fully return the piston 26 at the lowest operating pressure with the pressure being reduced to nearly that of the atmosphere prior to the next tool cycle. As the end of the driver 33 raises above the fastener rail 28, the next fastener is positioned into the guide cavity 32 ready to be driven by the next tool cycle.

Figure 2:
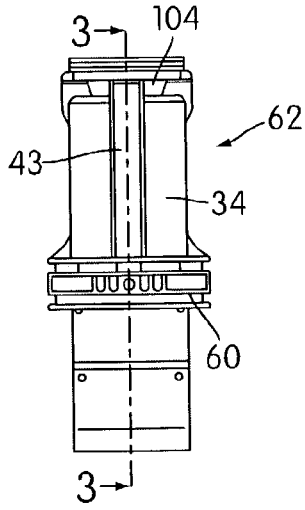
FIG. 2 is a frontal view of the cylinder of the fastener tool.

Turning now to FIG. 2, a frontal view of integrally cast structure 62, comprising the cylinder 34 and air passage 43, is shown. In one embodiment, structure 62 is molded from a molten polymeric material such as plastic in a mold structure. In another embodiment, structure 62 is molded from a molten metal material in a mold structure. The mold structure (not shown) is used to form the shape of structure 62. The mold structure defines both the cylinder 34 and the air passage 43. The structure 62 comprises integrally cast exhaust passage or air canal 43 communicating a volume of air above valve 38 with a trigger valve 36. Structure 62 is held inside body portion 14 of housing 12 (shown in FIG. 1) with sealing mount 60.

Figure 3:
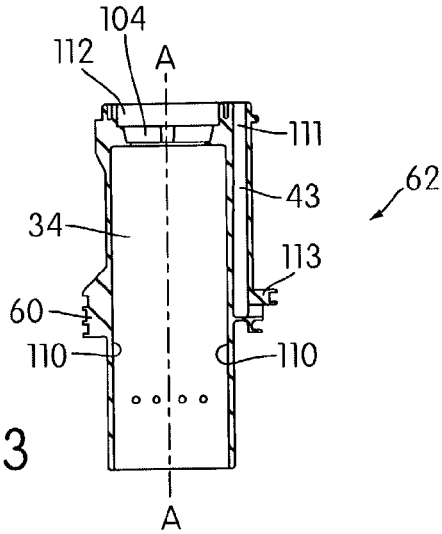
FIG. 3 is a longitudinal sectional view of the cylinder.
Figure 4:
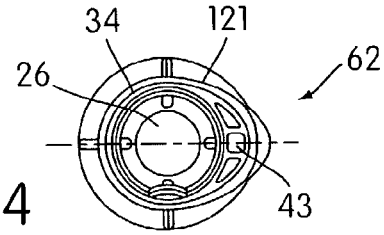
FIG. 4 is a top of the cylinder.

FIG. 3 is a longitudinal cross-section of structure 62 in the line 3—3 in FIG. 2. Again in this Figure is shown air canal 43. In addition, air canal 43 continues through an angular path leading to trigger valve 36. FIG. 4 is a transversal view of top of cylinder 34 showing clearly the air canal 43 in relation with the piston 26 in cylinder 34. Referring back to FIG. 3, structure 62 comprises cylindrical portion or cylinder 34. Specifically, the cylindrical portion or cylinder 34 has an inner cylindrical surface 110 adapted to cooperate with piston 26 (shown in FIG. 1). The cylindrical portion 34 has a longitudinal axis AA. The passage portion or air canal 43 is disposed radially outwardly from the inner cylindrical surface 110. The passage portion 43 has an upper portion 111 adapted to communicate with an upper portion 112 of the cylindrical portion 34. The passage portion 43 further has a lower portion 113 adapted to communicate with the trigger valve 36 (shown in FIG. 1). The peripheral seal structure 121 is also shown surrounding the upper portion 112 of cylinder structure 34 and the upper portion 111 of the signal passage 43.

Figure 5:
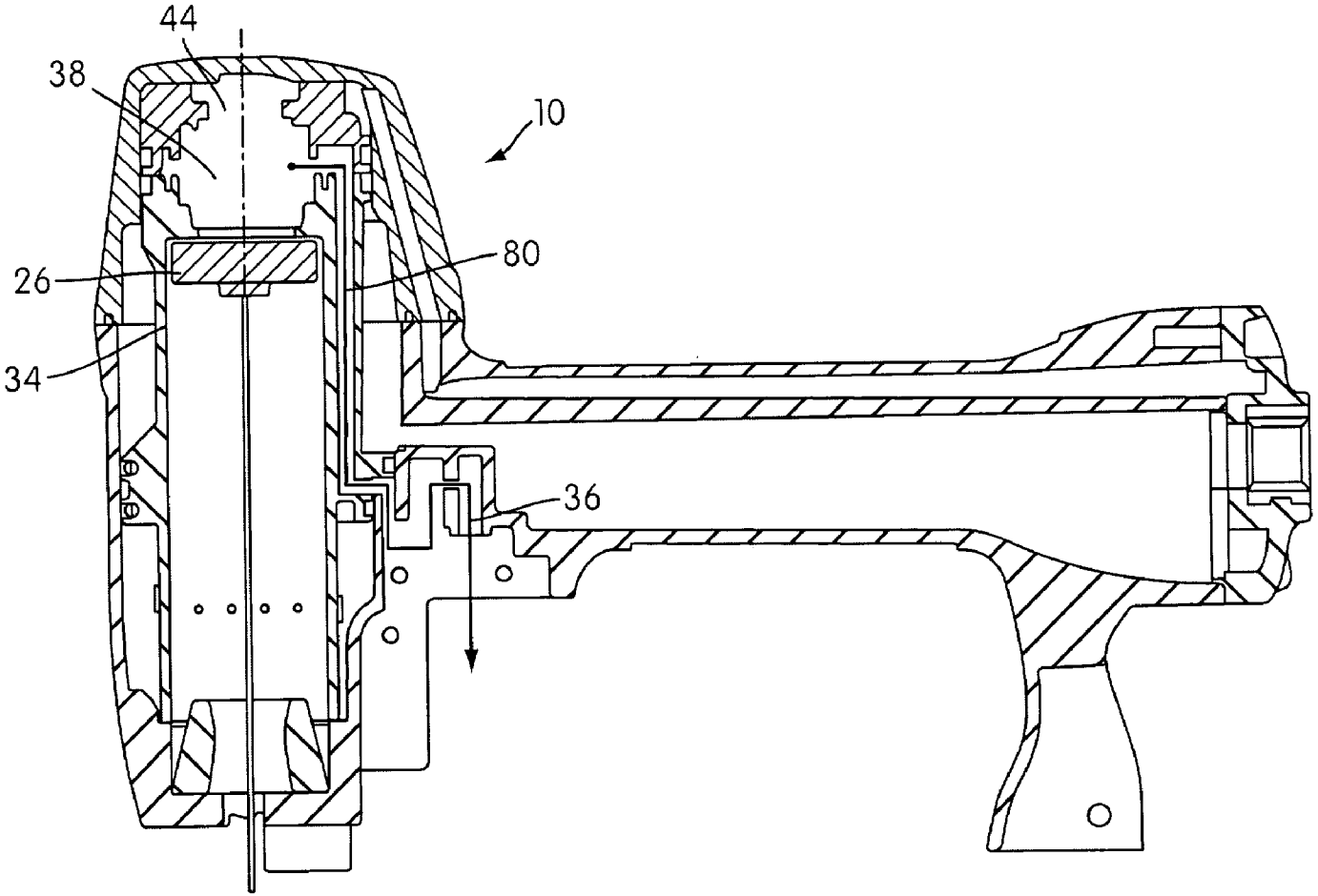
FIG. 5 shows the map of the air path for the pneumatic signal for actuating main valve 38.
Figure 1:
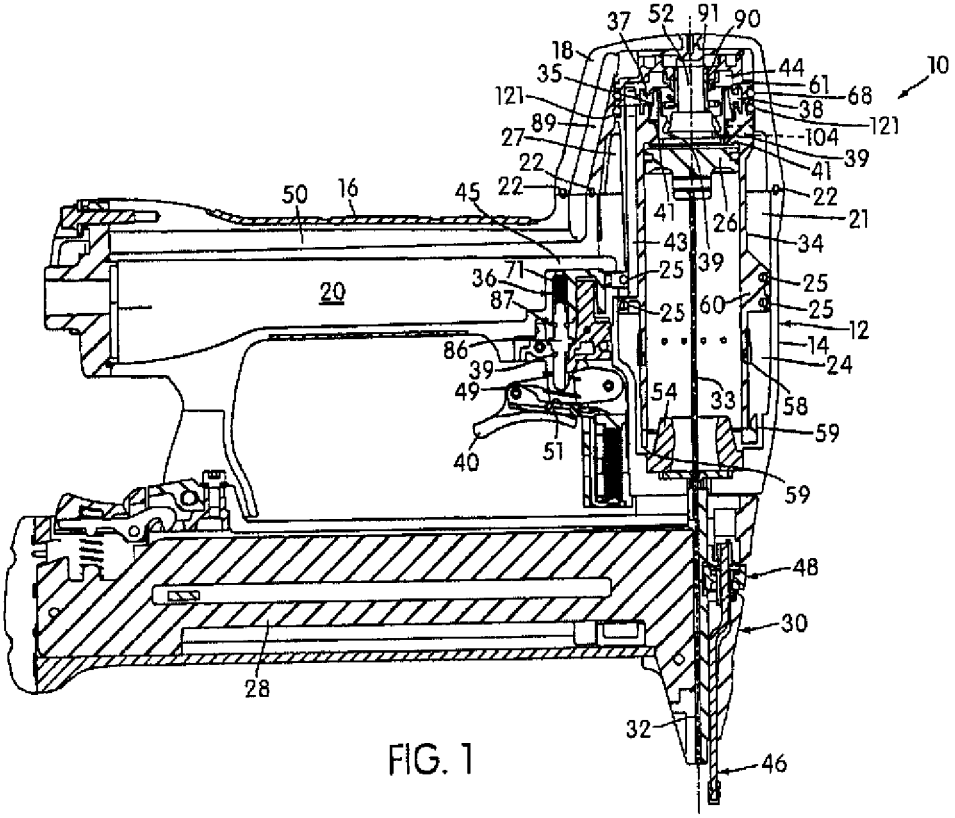

FIG. 5 shows the map of the air path 80 for actuating valve 38. The valve 38 remains against the cylinder 34 as long as both sides of valve 38 are subjected to equal air pressure. To fire the tool, the upper side of the valve 38, positioned opposite to cylinder 34, must be subjected to reduced pressure. This is done by exhausting cavity 44 through exhaust passageway 43 by actuating the trigger valve 36 as illustrated in FIG. 5. Now that the opposite sides of the valve 38 are subjected to unequal pressure, the valve 38 is forced to deflect upward thus the lower portion of valve 38 retracts from cylinder 34. Movement of the flexible valve 38 away from the top of cylinder 34 allows pressurized air to enter and force the piston 26 downward.

As previously described, during the tool cycle in which the piston 26 returns to the uppermost portion of the cylinder 34, the air above the piston 26 must be exhausted to the atmosphere. The compressed air used to drive the piston 26 downward can exhaust to the atmosphere by going through exhaust passageway 50 and out of exhaust port.

It should be appreciated that the integrally formed cylindrical structure 34 and signal passageway 43 can be used in any pneumatic fastening tool that requires such portions and is not limited to use in conjunction with the particular components employed in the preferred embodiment.

It must be understood the terms such as upper, lower, above, downward and the like are used in reference to the figures shown in the drawings solely for the purpose of clarity. While the preferred embodiment of the present invention has been shown, it is anticipated those skilled in the art may make numerous changes and modifications without departing from the spirit of this invention which is intended to be limited only by the scope of the following appended claims.

While the invention has been described in connection with particular embodiments, it is to be understood that the invention is not limited to only the embodiments described, but on the contrary it is intended to cover all modifications and arrangements included within the spirit and scope of the invention as defined by the claims, which follow.

What is claimed is:

1. A fastener driving device comprising:

a housing containing a chamber for storing compressed air;

a cylinder structure disposed within said housing;

a piston movably disposed within said cylinder;

a driver connected to said piston;

a main valve cooperable with said cylinder structure and movable between an open position and a closed position, wherein said open position allows air pressure to communicate with and drive said piston;

a trigger valve operable between a first position and a second position, wherein an air pressure signal passage communicates air pressure between said trigger valve and said main valve, wherein when said trigger valve is in said first position said main valve is closed and when said trigger valve is in said second position said main valve is open, wherein said cylinder structure and said signal passage are a one-piece, integrally formed structure such that said signal passage forms a conduit between said trigger valve and said main valve and a peripheral seal structure surrounding an upper portion of said cylinder structure and an upper portion of said signal passage facilitate air pressure communication of said upper portions.

2. A fastener driving device comprising:

a housing containing a chamber for storing compressed air;

a cylinder structure disposed within said housing;

a piston movably disposed within said cylinder;

a driver connected to said piston;

a main valve cooperable with said cylinder structure and movable between an open position and a closed position, wherein said open position allows air to move said piston through a drive stroke through said cylinder; and a trigger valve operable between a first position wherein said trigger valve communicates air pressure from said chamber to said main valve through a signal passageway so as to retain said main valve in a closed position, and a second position wherein said passageway is exhausted to atmosphere to permit said main valve to open, and wherein said cylinder and said signal passageway comprise a one-piece, integrally molded structure. claim 1, such that said signal passageway forms a conduit between said trigger valve and said main valve.

3. A fastener driving device as recited in claim 2, wherein said cylinder and said signal passageway form a single structure molded from a plastic.

4. A fastener driving device comprising: a housing containing a chamber for storing compressed air; a cylinder structure disposed within said housing; a piston movably disposed within said cylinder; a driver connected to said piston; a main valve disposed towards the top of said cylinder structure and movable between an open position and a closed position, wherein said open position allows air to move said piston through a drive stroke; and a trigger valve operable between a first position wherein said trigger valve establishes a first pressure signal at said main valve through a signal passageway so as to retain said main valve in a closed position, and a second position wherein said trigger valve establishes a second pressure signal at said main valve through said passageway to permit said main valve to open, and wherein said cylinder and said signal passageway comprise a one-piece, integrally molded structure such that said signal passage forms a conduit between said.

5. A fastener driving device as recited in claim 4, wherein said cylinder and said signal passageway form a single structure molded from a plastic.

* * * * *

UNITED STATES PATENT AND TRADEMARK OFFICE

CERTIFICATE OF CORRECTION

PATENT NO. : 7,204,402 B2
APPLICATION NO. : 10/406579
DATED : April 17, 2007
INVENTOR(S) : Brian C. Burke et al.

It is certified that error appears in the above-identified patent and that said Letters Patent is hereby corrected as shown below:

In Column 6, line 60, please delete ".claim 1".

In Column 8, line 5, after "between said", please add --trigger valve and said main valve--.

Signed and Sealed this

Twelfth Day of February, 2008

JON W. DUDAS
*Director of the United States Patent and Trademark Office*

UNITED STATES PATENT AND TRADEMARK OFFICE

CERTIFICATE OF CORRECTION

PATENT NO. : 7,204,402 B2
APPLICATION NO. : 10/406579
DATED : April 17, 2007
INVENTOR(S) : Brian C. Burke It is certified that error appears in the above-identified patent and that said Letters Patent is hereby corrected as shown below:

Please replace Fig. 1, on Sheet 1 of 3 with the attached correct Fig. 1 for this application.

Signed and Sealed this

Fifteenth Day of September, 2009

David J. Kappos

David J. Kappos
*Director of the United States Patent and Trademark Office*